United States Patent [19]

Diard et al.

[11] Patent Number: 4,795,184

[45] Date of Patent: Jan. 3, 1989

[54] SKI WITH DISSYMMETRICAL LATERAL SURFACES

[75] Inventors: Jean-Luc Diard, Annecy; Roger Pascal, Annecy le Vieux, both of France

[73] Assignee: Salomon S.A., Annecy Cedex, France

[21] Appl. No.: 49,931

[22] Filed: May 15, 1987

[30] Foreign Application Priority Data

May 23, 1986 [FR] France ..... 86 07852

[51] Int. Cl.[4] ..... A63C 5/04

[52] U.S. Cl. ..... 280/609

[58] Field of Search ..... 280/601, 608, 609, 600, 280/28; 441/65, 68, 79; 114/274, 283, 288

[56] References Cited

U.S. PATENT DOCUMENTS

| | | | |
|---|---|---|---|
| Re. 29,659 | 6/1978 | Bildner | 280/608 |
| 3,304,095 | 2/1967 | Carlton | 280/609 |
| 4,433,855 | 2/1984 | Wyke | 280/609 |

FOREIGN PATENT DOCUMENTS

| | | |
|---|---|---|
| 1958349 | 5/1971 | Fed. Rep. of Germany . |
| 3308599 | 9/1983 | Fed. Rep. of Germany . |
| 3441058 | 5/1986 | Fed. Rep. of Germany . |
| 1343014 | 10/1963 | France . |
| 2509185 | 1/1983 | France . |
| 2517548 | 6/1983 | France . |
| 2522976 | 9/1983 | France . |
| 2559673 | 8/1985 | France . |
| 43-24330 | 10/1968 | Japan . |

*Primary Examiner*—David M. Mitchell
*Assistant Examiner*—Tamara L. Finlay
*Attorney, Agent, or Firm*—Sandler & Greenblum

[57] ABSTRACT

A ski which includes a lower sliding surface connected to an upper surface by a first lateral surface and a second lateral surface along two opposed sides of the ski. The lateral surfaces are each inclined to form with the lower surface an average inclination angle of less than 90°. The first average inclination angle is less than the second average inclination angle along the useful zone of the ski.

28 Claims, 4 Drawing Sheets

SKI WITH DISSYMMETRICAL LATERAL SURFACES

BACKGROUND OF THE INVENTION

1. Field of the Invention

The present invention relates to skis for use on snow or ice, utilized in connection with winter sports.

2. Description of Background and Relevant Information

Skis normally utilized on snow comprise a lower sliding surface connected to two lateral surfaces along two lower edges provided with metallic corners, the lateral surfaces being connected to an upper surface. The lateral surfaces are generally substantially perpendicular to the lower and upper surfaces. The width of the lower surface is smaller in the central portion than in the front and rear portions of the skis. The skis have a relatively small width with respect to their length, their front end being curved upwardly to form a spatula.

It has been observed that this conventional configuration for skis is disadvantageous, particularly, during use of the ski on wet or frozen snow. In effect, on wet snow, the lateral perpendicular surfaces create tremendous friction during sliding in a longitudinal direction. Furthermore, during a turn, the lateral surfaces oppose flat pivoting of the skis. Similarly, when skiing on frozen snow, the lateral surfaces oppose penetration of the skis' corners into the snow.

Traditionally, skis have a transverse cross-section, which is substantially symmetrical with respect to a longitudinal vertical median plane. Such a configuration determines, in a relatively rigid and non-adjustable fashion, the fundamental parameters of the ski, such as the parameters of flexion, torsion, vibration, reaction on snow, etc.

The present invention, has particularly, as an object of avoiding the disadvantages associated with known ski structures, by proposing different shapes, thus, making it possible to substantially adjust the fundamental mechanical parameters of the ski, and particularly the characteristics of torsion, flexion, shock absorption, resonance frequency, penetration of corners into the snow or ice, and flat pivoting.

SUMMARY OF THE INVENTION

It is an object of the invention to provide a ski which includes a lower sliding surface connected to an upper surface by a first lateral surface and a second lateral surface along opposed sides of the ski. The upper surface includes a first edge, a second edge, and a median vertical plane, and the lower sliding surface includes a first edge portion, a second edge portion, and a median vertical plane, wherein the vertical planes are distinct from each other.

The first and second edges of the upper surface are respectively connected with the first and second edge portions of the lower sliding surface by the first and second lateral surfaces, which are inclined with respect to the lower sliding surface and form inclination angles of less than 90°. The average of first inclination angle is less than the average of second inclination angle over an useful zone of the ski. The ski further has a central zone and two end zones, i.e., front and rear, which together comprise the useful zone of the ski. Preferably, the first and second average angles of inclination are each less than about 70° along the respective end zones of the ski.

The averages of first and second inclination angles vary by approximately 10°-20°, along the end zones of the ski.

The ski according to the invention may comprise a rear zone, a central zone adapted to receive a ski binding, and a front zone which includes a tip portion which is curved upwardly to form a spatula. The first and second lateral surfaces converge on the spatula such that the first and second angles of inclination continuously decrease towards zero at the top portion of the ski.

The first and second angles of inclinations are different from each other along the longitudinal position of the ski, and each can be substantially constant or variable along the longitudinal length of the ski. The median vertical planes of the upper and lower surfaces are either parallel and offset laterally, or angularly offset or skewed with respect to each other. A distance between the vertical median planes of the upper and lower surfaces is greater in either a front end zone or a rear end zone of the ski.

It is another object of the invention to provide a ski in which the width of the upper surface is either substantially constant or variable, and the width of the lower surface is variable along the longitudinal length of the ski.

It is another object of the invention to provide a ski wherein one of the lateral surfaces along at least a portion of the central zone, is substantially vertical and forms with the lower sliding surface an inclination angle of 90°. The ski, according to the invention, has at least one lateral surface which includes an inclined upper portion and a substantially vertical lower portion.

In an alternative embodiment, both of the lateral surfaces have the inclined upper portion and the vertical lower portion. The upper portion may be substantially planar, and each of the first and second edge portions of the lower surface includes a metallic corner.

BRIEF DESCRIPTION OF THE DRAWINGS

Other objects, characteristics and advantages of the present invention will become clear from the following description with reference to particular embodiments, given with reference to the annexed drawings, in which.

DESCRIPTION OF PREFERRED EMBODIMENTS

Figure 1:
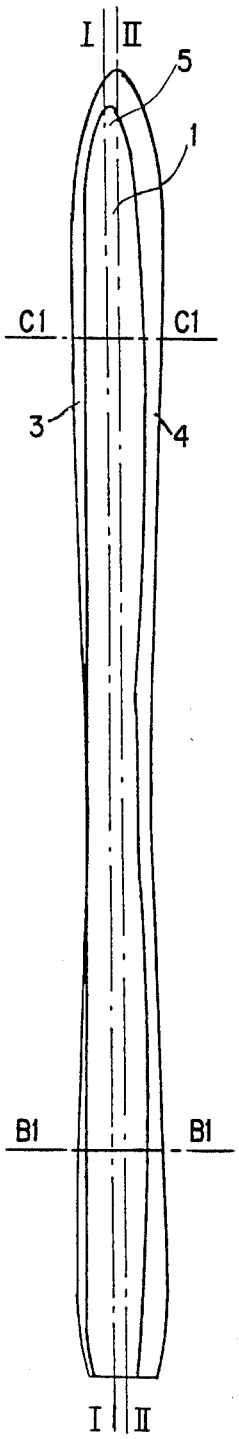
FIGS. 1-3 illustrate, in top plan view, three embodiments in which the median vertical planes of the upper and lower surfaces are parallel and laterally offset.

To achieve the above objects as well as others, the ski according to the invention has a dissymmmetrical transverse cross-section in which the first and second lateral surfaces are both inclined, and respectively, form with the lower surface inclination angles A1 and A2 which are less than 90°. The average of angle A1 formed by the first lateral surface with the lower surface of the ski along the useful length thereof, is less than the average of angle A2 formed by the second lateral surface with the lower surface of the ski over the useful length of the ski.

For this characteristic, one defines the useful length of the ski as being the total of the two portions limited, respectively, by each of the ends of the ski and by the central zone adapted to receive the boot binding.

This arrangement makes it possible, on the side having the largest angle, a secure and aggressive skiing sensation, while maintaining a normal sliding surface. On the other hand, the ski has a greater skiing sensation and more tolerant, particularly in deep snow.

According to a preferred embodiment, angles A1 and A2 are substantially constant over the entire useful length of the ski, defining a regular distribution of the capacity of the ski to cut deep snow during a lateral pivoting.

According to another embodiment, angles A1 and A2 are variable as a function of the longitudinal position of the transverse cross-section on the ski. One, thus, distributes in a non-uniform manner the resistance to lateral displacement parallel to the sliding surface, the resistance being greatest in the zones having a large angle A, and being less in the zones having a small angle A.

Angles A1 and A2 are, preferably less than 70°, and the difference between them is between 10° and 20°. In this range of values, the advantages achieved by dissymmetry of the lateral surfaces are very substantial, and the different reactions of the two skis utilized simultaneously by the user, particularly in the course of turns, substantially improves their efficacy without causing any interference or difficulty in skiing.

To this end, the skis are normally utilized in pairs, held along in substantially parallel directions, slide along their longitudinal direction, and, in the course of turning, slide laterally. The ski according to the invention, having a dissymmetrical configuration with respect to a vertical longitudinal median surface, must be paired to have reverse dissymmetries with respect to one another. For example, a right ski having a lateral right surface, which is more inclined than the left lateral surface, will be paired with a left ski having a left lateral surface which is more inclined than the right lateral surface. Conversely, a right ski having a right lateral surface which is less inclined than the left lateral surface will be paired with a left ski whose left lateral surface is less inclined than the right lateral surface. It will be appreciated that, in the course of turning, the difference in symmetry of two skis produce different effects in the first ski with respect to the second ski. According to the invention, these effects being about a favorable result in the pair of skis in the course of turning, i.e., a result which favors, for example, gripping during turning and maintaining the skis substantially parallel to each other.

According to one embodiment, the upper surface and the lower surface of the ski are, respectively, symmetrical with respect to the vertical longitudinal median planes. In this embodiment, the vertical median planes of the upper surface and of the lower surface of the ski are parallel and laterally offset with respect to one another. According to this arrangement, angles A1 and A2 have a substantially constant difference along the entire longitudinal length of the ski.

According to a second embodiment, the vertical median planes are angularly offset with respect to one another. One, thus, obtains a regular progressive difference between angles A1 and A2, along the entire longitudinal length of the body of the ski.

Figure 6:
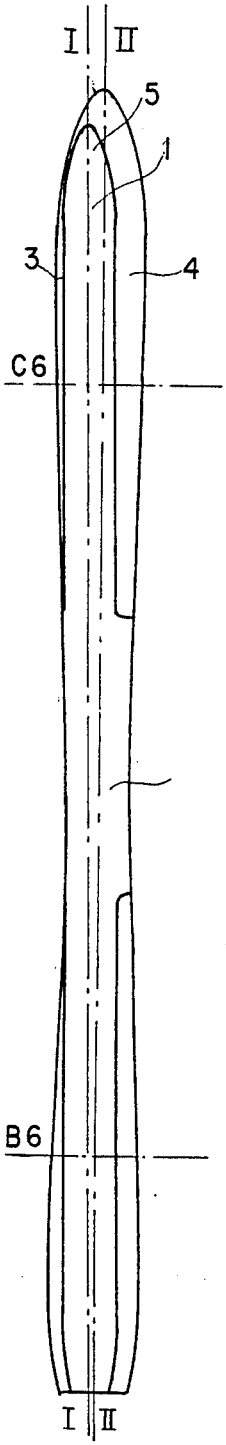
Figure 7:
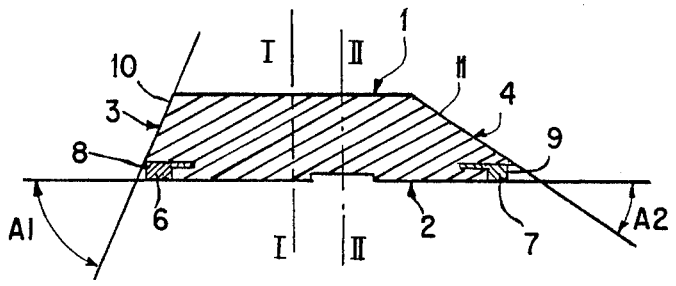
FIG. 7 is a transverse cross-section, in an enlarged scale, of the ski along planes C1-C6 of FIGS. 1-6.
Figure 8:
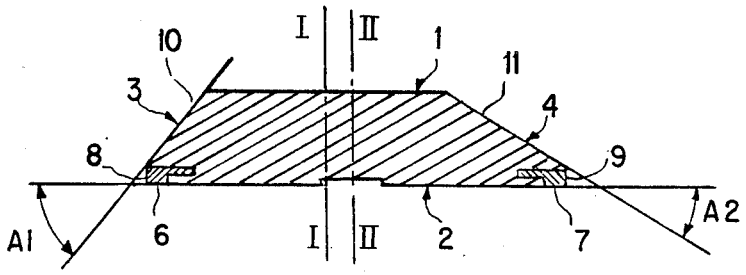
FIG. 8 is a transverse cross-section, on an enlarged scale, of the ski along planes B1-B3 of FIGS. 1-3.
Figure 9:
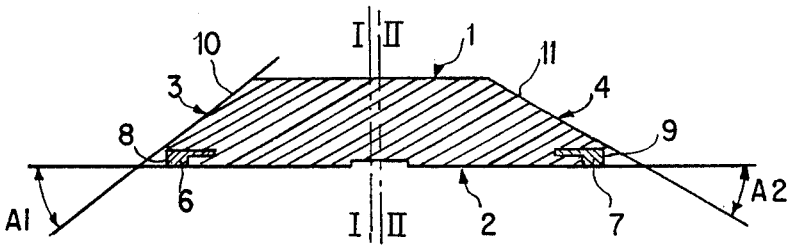
FIG. 9 is a transverse cross-section on an enlarged scale of the ski along planes B4-B6 of FIGS. 4-6.

As shown in FIGS. 7–9, the ski according to the present invention comprises an upper surface 1, a lower sliding surface 2, and two lateral surfaces 3 and 4. A front portion 5 of the ski is curved upwardly to form a spatula. The lower surface is bordered by two lower edges 6 and 7, generally provided with metallic corners. The lower surface 1, as shown in FIGS. 1–6, has, in its central portion, a relatively reduced width, which progressively increases when one approaches either of the two ends of the ski.

The lateral surfaces 3 and 4 form, with the lower surface 2 of the ski, interior inclination angles A1 and A2, respectively, as shown in FIGS. 7–9.

In the particular embodiments shown in the Figures, lateral surfaces 3 and 4 comprise a lower zone constituted by respective sides 8 and 9, and substantially perpendicular to the lower surface 2 of the ski, and an upper zone, respectively 10 and 11, having average inclination angles A1 and A2. Sides 8 and 9, preferably, have a height of several millimeters, the largest portion of the lateral surfaces being constituted by upper zones 10 and 11.

According to the invention, the average inclination angles A1 and A2 are each less than 90°, and are different from one another, to define a dissymmetry.

In the following description, with reference to the Figures, only one of the two skis in a pair normally utilized by a skier will be described. One such ski can, for example, be a right ski, or a left ski, the effects obtained are obviously quite different, depending upon whether the ski shown in the Figures, is affixed to the right foot or the left foot of the user. Furthermore, the second ski of the pair, not shown in the Figures, must have a reversed dissymmetry with respect to the first ski. Thus, if one considers the ski shown in FIG. 7 as a right ski, in which angle A1 of the left lateral surface is greater than angle A2 of the right lateral surface, the left ski must have an angle A1 less than angle A2.

Preferably, angles A1 and A2 are both less than 70° along the useful length of the ski.

The difference between angles A1 and A2, is preferably between about 10° and 20°, along the useful length of the ski.

For clarity, FIGS. 1–6 illustrate, in a top plan view, skis whose width are relatively large with respect to their length. One, thus can visually accentuate the lateral and angular offsets constituting the dissymmetries of the skis. One of ordinary skill in the art will know how to adapt the dissymmetries defined by the present invention to skis of different proportions.

In the embodiment illustrated in FIG. 1, the upper surface has a variable width as a function of the position considered along the length of the ski. The upper surface 1 and lower surface 2 are both positioned with respect to one another in a manner so as to define angles A1 and A2 substantially constant along the useful length of the ski.

Figure 2:
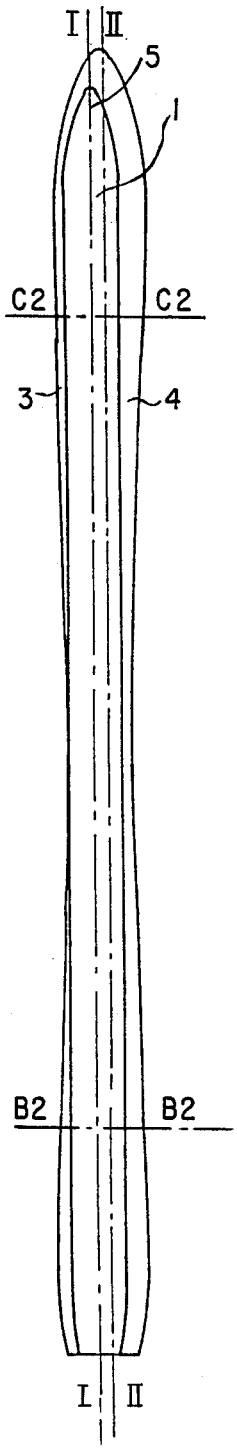

In the embodiment shown in FIG. 2, the upper surface 1 of the ski has a constant width, while the lower surface 2 has a variable width. As a result, angles A1 and A2 have a value which varies as a function of the position considered along the length of the ski, a value which likewise depends on the thickness of the ski and the zone considered.

Figure 3:
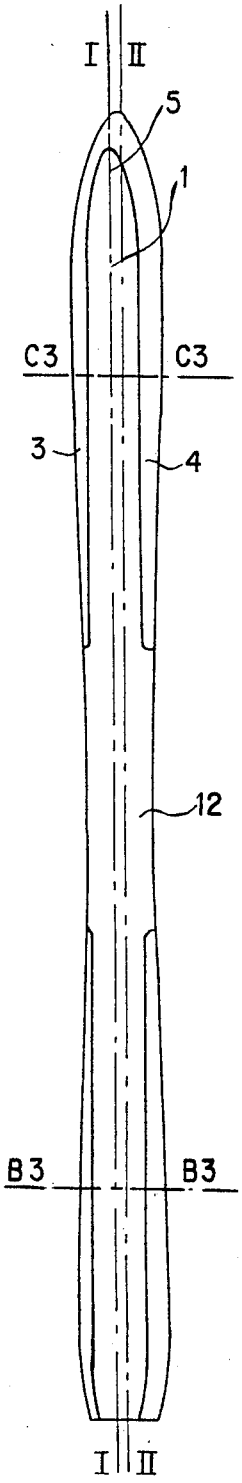
Figure 10:
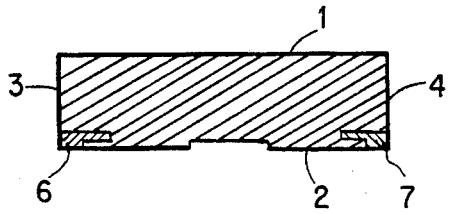
FIG. 10 is a transverse cross-section on an enlarged scale of the ski along plane D3 of FIG. 3.

In the embodiment shown in FIGS. 3 and 10, intermediate zone 12 of the upper surface 1 of the ski, or zone adapted to receive the boot binding, is wider, and defines angles A1 and A2, at least one of which is substantially equal to 90° (FIG. 10). A transverse cross-section of the ski along a similar zone of FIG. 6 would be very similar. The intermediate zone separates the two zones which constitute the useful length of the ski and which extend to the ends.

In the three embodiments of FIGS. 1, 2 and 3, the upper surface 1 and lower surface 2 of the ski have vertical median planes, I—I and II—II, respectively, which are parallel to one another and laterally offset with respect to one another. The offset between planes I—I and II—II is substantially constant over the entire useful length of the ski (FIGS. 7 and 8).

Figure 4:
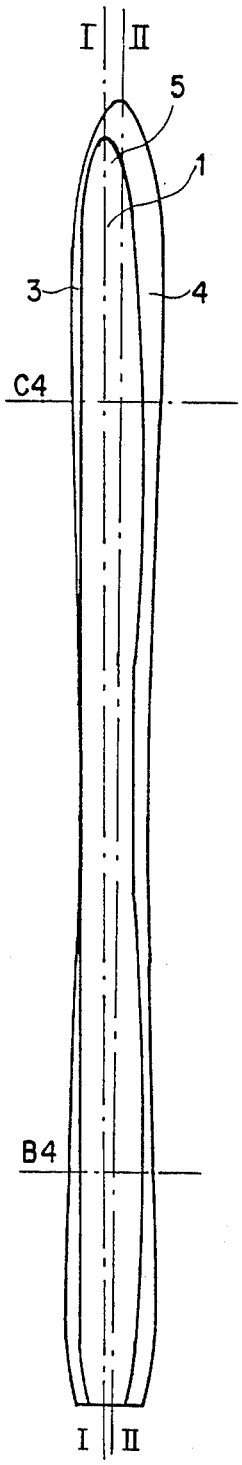
FIGS. 4-6 illustrate, in top plan view, three embodiments in which the median vertical planes of the upper and lower surfaces of the ski are angularly offset.
Figure 5:
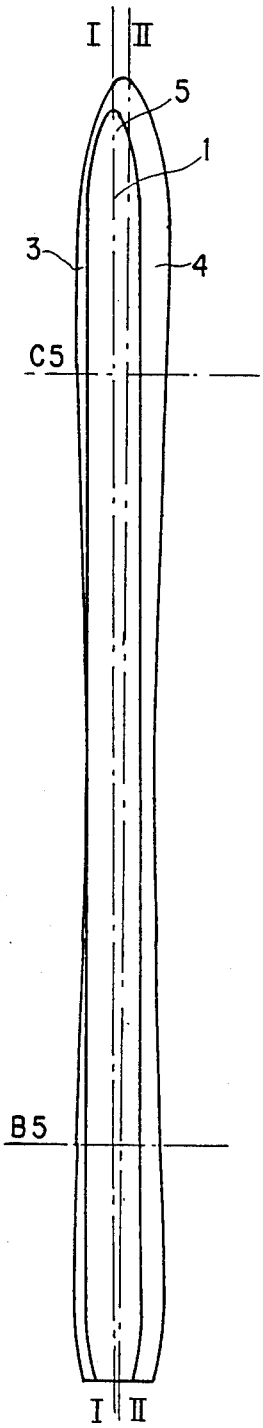

In the embodiments of FIGS. 4, 5 and 6, the upper surface 1 and lower surface 2, respectively, have the same shapes as in the embodiments of FIGS. 1–3, respectively. However, in the embodiments of FIGS. 4–6, the vertical median planes I—I and II—II are angularly offset with respect to one another. Thus, in the embodiments shown, planes I—I and II—II, are further spaced in the front cross-sections C4–C6 (FIG. 7) than in the rear cross-sections B4–B6 (FIG. 9).

Conversely, one can define another embodiment in which planes I—I and II—II of the front cross-sections C4–C6 are closer together than in cross-sections B4–B6.

The angular offset makes it possible to give to the skis a high turn capacity to one side and an underturn capacity to the other.

Although the invention has been described with reference to particular means, materials and embodiments, it is to be understood that the invention is not limited to the particulars disclosed and extends to all equivalents within the scope of the claims appended hereto.

What is claimed is:

1. A ski for use on ice or snow comprising:

a lower sliding surface connected to an upper surface by a first lateral surface and a second lateral surface along opposed sides of the ski, said ski having a central zone and two ends which together comprise a useful zone of said ski, each of said lateral surfaces being inclined relative to said lower surface and forms at least along said ski ends an inclination angle, with said lower surface, wherein the average inclination angles of each lateral surface is less than 90°, wherein said first average inclination angle is less than said second average inclination angle over the useful zone of the ski.

2. The ski of claim 1, wherein each of said first inclination angle and said second inclination angle is substantially constant along the respective ends of the ski.

3. The ski of claim 1, wherein each of said first inclination angle and said second inclination angle varies along the length of the ski.

4. The ski of claim 1, wherein the average of each of said first inclination angle and said second inclination angle is less than about 70° along the respective ends of the ski.

5. The ski of claim 1, wherein the averages of first inclination angle and of the second inclination angle vary by approximately 10°–20° along the ends of the ski.

6. The ski of claim 1, wherein each of said upper surface and said lower surface comprises a longitudinal median plane, said planes being parallel and offset laterally with respect to one another.

7. The ski of claim 1, wherein each of said upper surface and said lower surface comprises a median vertical plane, said planes being angularly offset with respect to one another.

8. The ski of claim 7, wherein said planes are skewed with respect to each other.

9. A ski for sliding on ice or snow, comprising:

(a) an upper surface comprising a first edge, a second edge, and a median vertical plane;

(b) a lower sliding surface comprising a first edge portion, a second edge portion, and a median vertical plane; and (c) a plurality of lateral surfaces, whereby a first one of said lateral surfaces connects said first edge of said upper surface with said first edge portion of said lower surface, and a second one of said lateral surfaces connects said second edge of said upper surface with said second edge portion of said lower surface, wherein said vertical planes are distinct from each other; and wherein each of said first lateral surface and said second lateral surface is inclined relative to said lower sliding surface thereby forming a first internal angle of inclination and a second internal angle of inclination, respectively.

10. The ski of claim 9, wherein said first and second angles of inclination are different from each other along any longitudinal position of the ski.

11. The ski of claim 10, wherein each of said first angle of inclination and said second angle of inclination is substantially constant along the entire longitudinal length of the ski.

12. The ski of claim 10, wherein each of said first angle of inclination and said second angle of inclination is variable along the longitudinal length of the ski.

13. The ski of claim 12, wherein the vertical median plane of said upper surface is angularly offset from the vertical median plane of said lower sliding surface.

14. The ski of claim 13, wherein the width of said upper surface and the width of said lower surface are each variable along the longitudinal length of the ski.

15. The ski of claim 13, wherein the width of said uppe surface is substantially constant while the width of said lower surface is variable along the longitudinal length of the ski.

16. The ski of claim 13, further comprising a front zone, a central zone adapted to receive a ski binding, and a rear zone, said front zone comprising a tip portion which is curved upwardly to form a spatula.

17. The ski of claim 16, wherein each of said first lateral surface and said second lateral surface converge on said spatula such that said first and second angles of inclination continuously decrease towards zero at said tip portion of the ski.

18. The ski of claim 16, wherein a distance between the vertical median planes of said upper surface and said lower sliding surface is greater in said front zone of the ski.

19. The ski of claim 16, wherein a distance between the vertical median planes of said upper surface and said lower sliding surface is greater in said rear zone of the ski.

20. The ski of claim 9, wherein said vertical median planes of said upper surface and said lower sliding surface are parallel to each other.

21. The ski of claim 9, wherein the width of said upper surface and the width of said lower surface are each variable along the longitudinal length of the ski.

22. The ski of claim 9, wheein the width of said upper surface is substantially constant while the width of said lower sliding surface is variable along the longitudinal length of the ski.

23. The ski of claim 9, wherein each of said first angle of inclination and said second angle of inclination is less than about 70°.

24. The ski of claim 23, wherein the difference between said first angle of inclination and said second angle of inclination at any cross-sectional portion of said ski is between about 10°-20°.

25. The ski of claim 9, wherein at least one of said first lateral surface and said second lateral surface comprises an inclined upper portion and a substantially vertical lower portion.

26. The ski of claim 25, wherein each of said first lateral surface and said second lateral surface comprises an upper portion and a lower portion.

27. The ski of claim 26, wherein said upper inclined porton is substantially planar.

28. The ski of claim 9, wherein each of said first edge portion and said second edge portion comprises a metallic corner.

* * * * *

UNITED STATES PATENT AND TRADEMARK OFFICE

CERTIFICATE OF CORRECTION

PATENT NO. : 4,795,184

DATED : January 3, 1989

INVENTOR(S) : J. DIARD et al.

It is certified that error appears in the above-identified patent and that said Letters Patent is hereby corrected as shown below:

At column 3, line 56, change "being" to ---bring---.

At column 6, line 46, in claim 15, change "uppe" to ---upper---.

At column 7, line 4, in claim 22, change "wheein" to ---wherein---.

Signed and Sealed this

First Day of January, 1991

*Attest:*

HARRY F. MANBECK, JR.

*Attesting Officer*

*Commissioner of Patents and Trademarks*